US006198894B1

(12) United States Patent
Park

(10) Patent No.: US 6,198,894 B1
(45) Date of Patent: Mar. 6, 2001

(54) APPARATUS FOR DRIVING SQUEEGEE ROLLER OF LIQUID ELECTROPHOTOGRAPHIC PRINTER

(75) Inventor: Woo-yong Park, Suwon (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/492,283

(22) Filed: Jan. 27, 2000

(30) Foreign Application Priority Data

Jan. 26, 1999 (KR) ..... 99-2401

(51) Int. Cl.[7] ..... G03G 15/10
(52) U.S. Cl. ..... 399/249
(58) Field of Search ..... 399/249, 251, 399/345, 348, 75

(56) References Cited

U.S. PATENT DOCUMENTS 3,907,423 * 9/1975 Hayashi et al. ..... 399/249
4,056,315 * 11/1977 Ariyama et al. ..... 399/249

* cited by examiner

*Primary Examiner*—Joan Pendegrass
(74) *Attorney, Agent, or Firm*—Sughrue, Mion, Zinn, Macpeak & Seas, PLLC

(57) ABSTRACT

An apparatus for driving a squeegee roller of a liquid electrophotographic printer including a squeegee gear coaxially installed at one shaft end of the squeegee roller, a driving gear installed such that in a state where the squeegee roller contacts the photoreceptor belt, the center of the rotation shaft thereof is positioned on a plane perpendicular to the elevating direction of the squeegee roller and passing through the center of the rotation shaft of the squeegee roller, to be engaged with the squeegee roller, and a driving source having an output shaft for rotating the driving gear to drive the squeegee roller to rotate in a reverse direction to the circulating direction of the photoreceptor belt. Therefore, even when a drip line removal mode of the printer is terminated to be switched to a stop mode, the squeegee roller does not stop but keeps rotating in reverse while it is in the course of being lowered from the photoreceptor belt, thereby removing a drip line on the photoreceptor belt as accurately as possible.

2 Claims, 7 Drawing Sheets

APPARATUS FOR DRIVING SQUEEGEE ROLLER OF LIQUID ELECTROPHOTOGRAPHIC PRINTER

BACKGROUND OF THE INVENTION

1. Field of the Invention

The present invention relates to a liquid electrophotographic printer, and more particularly, to a squeegee roller driving apparatus for squeegeeing excess developer liquid from a transfer surface of a photosensitive medium.

2. Description of the Related Art

As shown in FIG. 1, a liquid electrophotographic printer such as a color laser printer includes a development device 20 for supplying a developer liquid to an electrostatic latent image formed on a transfer surface 10*a* of a photoreceptor belt 10 as a photosensitive medium to develop the electrostatic latent image.

In the development device 20, a developer liquid spray nozzle 21, a development roller 22 and a squeegee roller 23 are sequentially installed. The development roller 22 transfers a developer liquid to the transfer surface 10*a* of the photoreceptor belt 10. The squeegee roller 23 squeezes the developer liquid transferred on the transfer surface 10*a* of the photoreceptor belt 10. Reference numerals 12 and 13 denote backup rollers opposite to the development roller 22 and the squeegee roller 23 to apply tension to the photoreceptor belt 10.

The development roller 22 and the squeegee roller 23, as shown in FIG. 2, are installed in separate elevation apparatuses 32 and 33, respectively to be controlled to elevate according to the operating mode of the printer. Although not shown in detail, generally the elevation apparatuses 32 and 33 each includes a spring (not shown) configured to adjust its elastic force by a cam mechanism (not shown). In response to the adjusted elastic force of the spring, the development roller 22 and the squeegee roller 23 are lifted or lowered to be engaged in proximity of or disengaged away from to the photoreceptor belt 10.

In the case where the printer is in a printing mode, the development roller 22 and the squeegee roller 23 remain in a lifted state by the driving of the elevation apparatuses 32 and 33. Here, the development roller 22 is lifted up to a location at which a gap of about 0.1 to 0.2 mm is formed between the photoreceptor belt 10 and the development roller 22. The squeegee roller 22 is lifted up to a location at which it presses the photoreceptor belt 10 with a force of approximately 20 kilograms even after it contacts the photoreceptor belt 10. In the case where the printer is in a stop mode, the development roller 22 and the squeegee roller 23 are lowered to be completely disengaged from the photoreceptor belt 10.

As the printing operation is carried out, the developer liquid may accumulate and remain on a contact portion of the squeegee roller 23 and the photoreceptor belt 10. The excess developer liquid remaining on the photoreceptor belt 10 is referred to as a drip line (D). In order to obtain a clean-quality printed image, it is necessary to remove the drip line D at regular time intervals during the printing operation.

FIG. 2 illustrates the positional relationship between the photoreceptor belt 10, the development roller 22 and the squeegee roller 23 in a drip line removal mode, in which the development roller 22 is completely disengaged from the photoreceptor belt 10, as in the stop mode. Also, the squeegee roller 23 is controlled to rotate in reverse with respect to the rotating direction of the photoreceptor belt 10 in the printing mode, while the photoreceptor 10 remains pressed with a loading force of approximately 2 kilograms by adjusting the elastic force of the spring provided in the elevation apparatus 23.

As shown in FIG. 3, a conventional driving apparatus for rotating the squeegee roller 23 in reverse with respect to the traveling direction of the photoreceptor belt 10 includes a squeegee gear 24 installed at a shaft end of the squeegee roller 23, and a driving gear 25 installed at an output end of a driving source (M) positioned above the squeegee gear 24 to be engaged therewith.

In general, the squeegee roller 23 is configured to be capable of rotating in a forward or reverse direction, by installing a one-way bearing or clutch (not shown) on the driving shaft of the driving gear 25. In other words, the squeegee roller 23 contacts the photoreceptor belt 10 in the printing mode to rotate in the same direction as that of the photoreceptor belt 10 (in a forward direction) due to a frictional force therebetween. In a drip line removal mode, the squeegee gear 24 is subjected to the driving force applied from the driving gear 25 to rotate reversely.

According to the above-described conventional squeegee roller driving apparatus, in the course of switching from a drip line removal mode, as shown in FIG. 4A, to a stop mode, as shown in FIG. 4B, the squeegee roller 23 is lowered so that the driving gear 25 and the squeegee gear 24 are spaced apart from each other, thereby stopping rotation. In this case, since the squeegee roller 23 stops temporarily on the transfer surface of the photoreceptor belt 10, the drip line D is not completely removed due to the rolling trace of the squeegee roller 23, leaving a small amount of carrier (approximately 0.005 gram) on the transfer surface of the photoreceptor belt 10. As shown in FIG. 5, the remaining carrier is transferred to an image (D') on printing paper 1, degrading the print quality of the printed image.

SUMMARY OF THE INVENTION

To solve the above problem, it is an object of the present invention to provide an apparatus for driving a squeegee roller of a liquid electrophotographic printer, which can enhance the accuracy in removing a drip line, by improving a driving mechanism such that the squeegee roller keeps rotating reversely for a while even when the squeegee roller is lowered in the course of switching from a drip line removal mode to a stop mode.

Accordingly, to achieve the above object, there is provided an apparatus for driving a squeegee roller of a liquid electrophotographic printer, comprising a squeegee roller installed to be of operative to rotate in contact with a photoreceptor belt circulating along a track and to be lifted to and lowered from the photoreceptor belt, a squeegee gear coaxially installed at one shaft end of a rotation shaft of the squeegee roller, a driving gear installed such that in a state where the squeegee roller contacts the photoreceptor belt, the center of the rotation shaft thereof is positioned on a plane perpendicular to an elevating direction of the squeegee roller and passing through a center of the rotation shaft of the squeegee roller, to be engaged with the squeegee roller, and a driving source having an output shaft for rotating the driving gear to drive the squeegee roller to rotate in a reverse direction to with respect to circulating direction of the photoreceptor belt.

Preferably, the driving gear is positioned in the upstream of the squeegee gear with respect to the circulating direction of the photoreceptor belt to be engaged therewith.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 1:
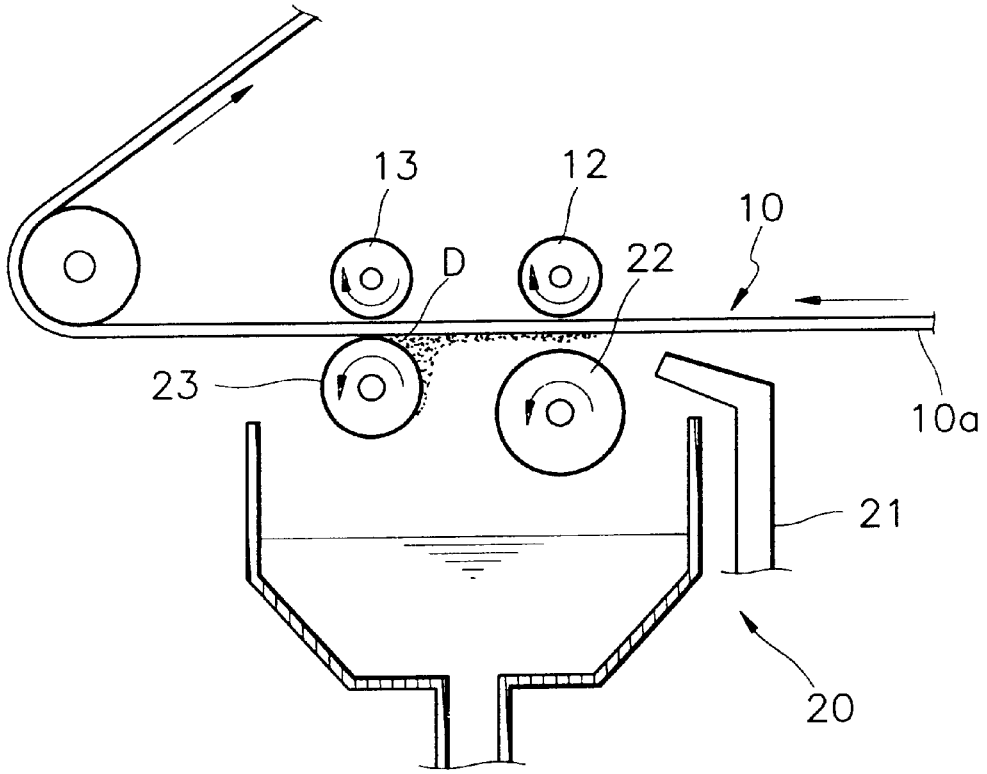
FIG. 1 (PRIOR ART)
FIG. 1 is a schematic diagram illustrating important parts of a conventional liquid electrophotographic printer.
Figure 2:
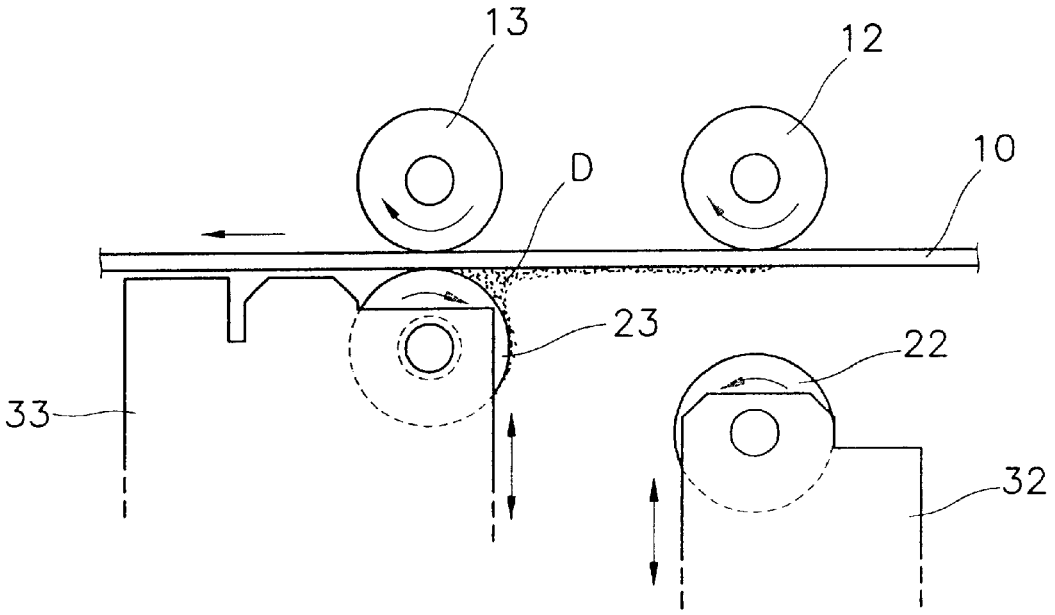
FIG. 2 (PRIOR ART)
FIG. 2 is a schematic diagram illustrating important parts of a development device for the conventional liquid electrophotographic printer shown in FIG. 1.
Figure 3:
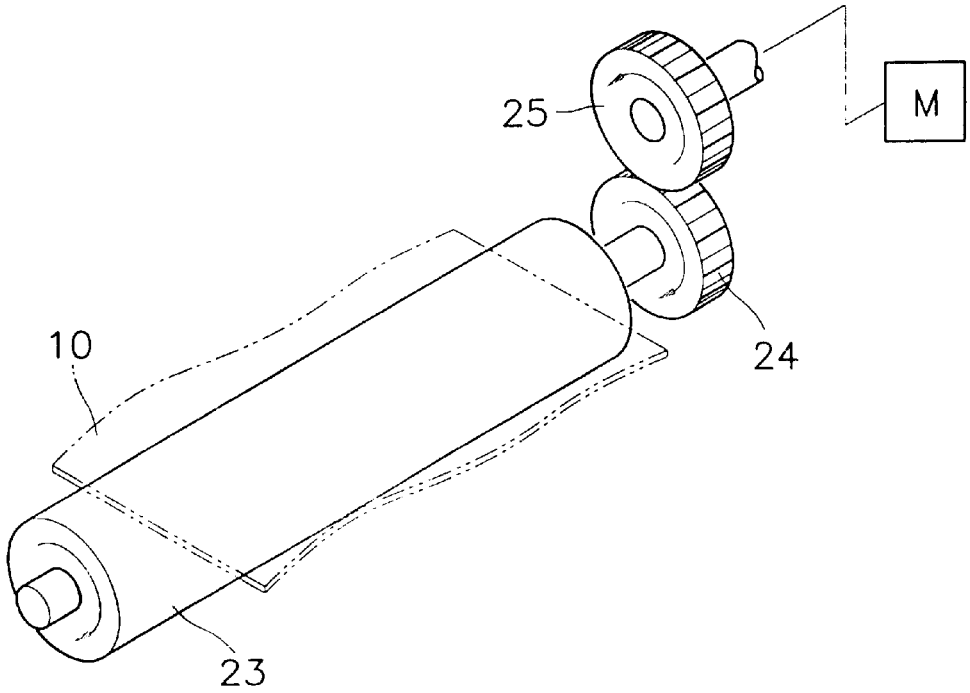
FIG. 3 (PRIOR ART)
FIG. 3 is a perspective view schematically illustrating important parts of a squeegee roller driving apparatus for the conventional liquid electrophotographic printer shown in FIG. 1.
Figure 4A:
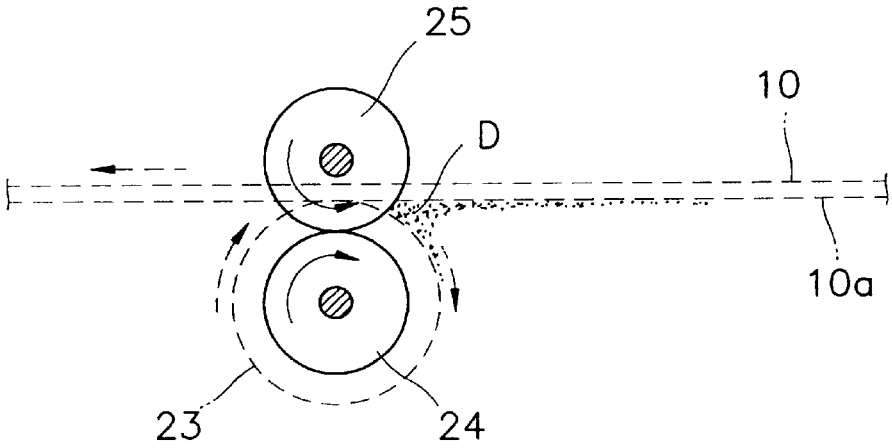
FIG. 4A (PRIOR ART)
FIGS. 4A and 4B are schematic plan views illustrating the operational states of gears according to the operating mode of the conventional squeegee roller driving apparatus shown in FIG. 3.
Figure 4B:
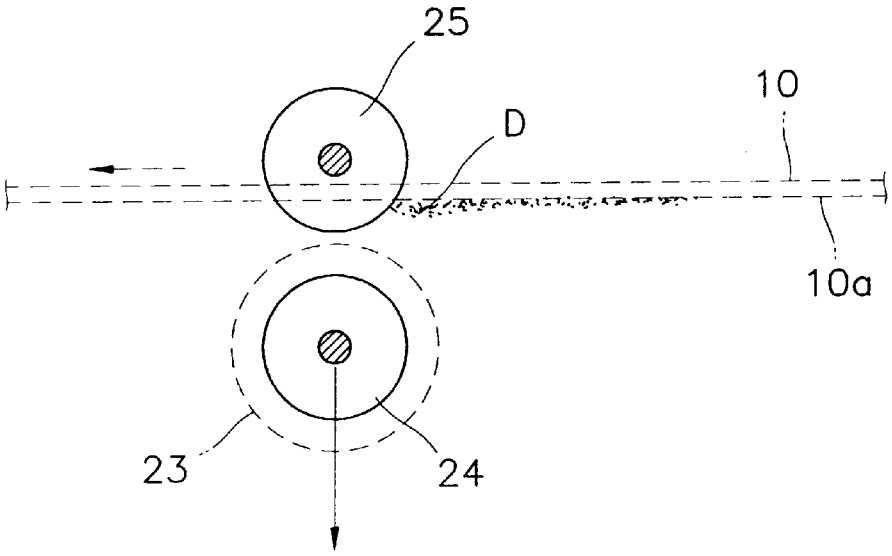
FIG. 4B (PRIOR ART)
Figure 5:
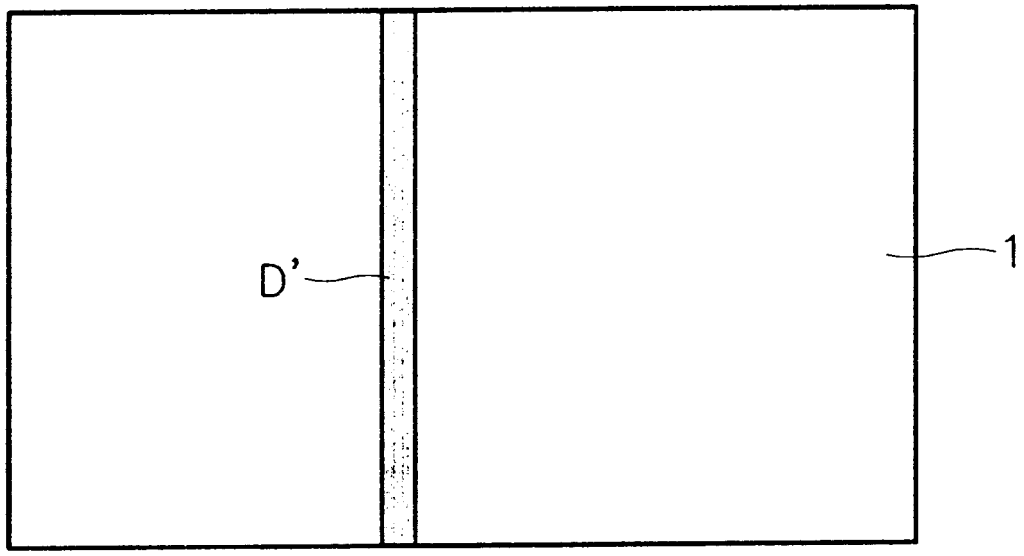
FIG. 5 (PRIOR ART)
FIG. 5 is a schematic plan view illustrating the state of a printed image when the conventional squeegee roller driving apparatus shown in FIG. 3 is adopted.
Figure 6:
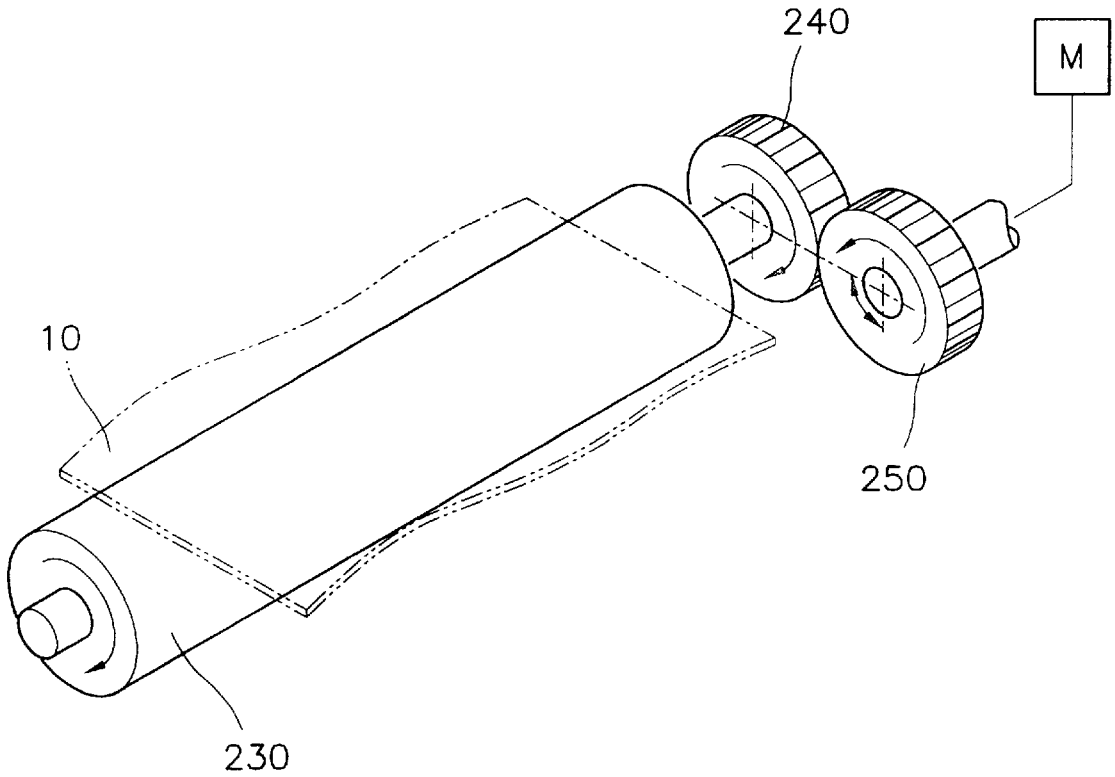
FIG. 6 is a perspective view schematically illustrating important parts of a squeegee roller driving apparatus for a liquid electrophotographic printer according to the present invention.

Referring to FIG. 6, an apparatus for driving a squeegee roller for a liquid electrophotographic printer according to the present invention includes a squeegee roller 230 installed to be lifted to and lowered from a photoreceptor belt 10 circulating along a continuous loop track, a squeegee gear 240 installed at one shaft end thereof, a driving gear 250 engaged with the squeegee gear 240, and a driving source (M) having an output shaft for rotating the driving gear 250 to drive the squeegee roller 230 to rotate in a reverse direction to the circulating direction of the photoreceptor belt 10.

The feature of the present invention lies in that in a state where the squeegee roller 230 contacts the photoreceptor belt 10, the driving gear 250 is installed such that the center of the rotation shaft thereof is positioned on a plane perpendicular to the elevating direction of the squeegee roller 230 and passing through the center of the rotation shaft of the squeegee roller 230, to be engaged with the squeegee roller 230. According to the present invention, the driving gear 250 is preferably positioned upstream of the squeegee gear 240 with respect to the traveling direction of the photoreceptor belt 10.

The squeegee roller 230 contacts the transfer surface of the photoreceptor belt 10 to rotate in the same direction as the photoreceptor belt 10 due to a frictional force therebetween. Also, the elevation of the squeegee roller 230 is controlled by a separate elevation apparatus (not shown) according to the operating mode of the printer. Although not shown, the elevation apparatus includes a spring and a cam mechanism for elevating the squeegee roller 230, as in the conventional apparatus.

The squeegee roller 230 is configured to rotate in a forward or reverse direction such that a one-way bearing or clutch (not shown) is installed on the driving shaft of the driving gear 250. In other words, the squeegee roller 230 contacts the photoreceptor belt 10 in the printing mode to rotate in the same direction as that of the photoreceptor belt 10 (in a forward direction) due to a frictional force therebetween. In a drip line removal mode, the squeegee gear 240 is subjected to the driving force applied from the driving gear 25 to rotate reversely.

According to the above-described squeegee roller driving apparatus according to the present invention, even when the squeegee roller 230 is lowered in the course of switching from a drip line removal mode to a stop mode, the reverse rotation of the squeegee gear 240 can be retained for a while.

Thus, since the squeegee roller 230 keeps rotating reversely during the period from the drip line removal mode to the initial stop mode, without stopping in a state where it contacts the transfer surface of the photoreceptor belt 10, the drip line D can be removed as accurately as possible. This will now be described with reference to FIGS. 7A, 7B and 7C, illustrating the operational states of gears according to the operating mode of the squeegee roller driving apparatus for a liquid electrophotographic printer according to the present invention shown in FIG. 6.

Figure 7A:
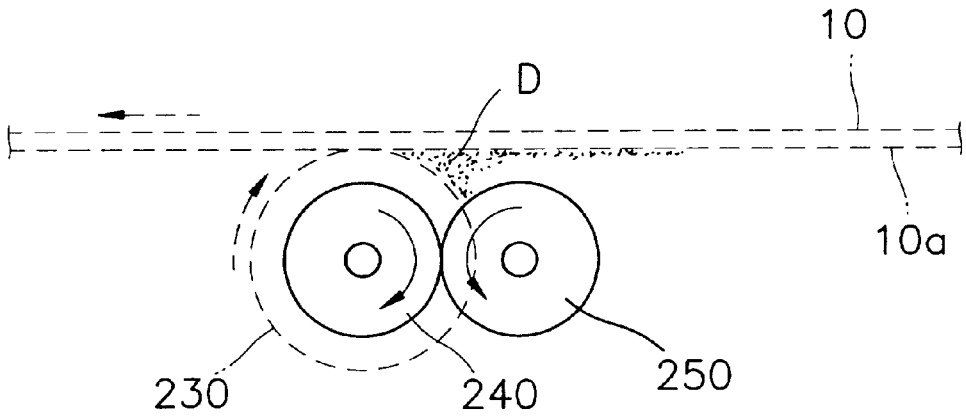
FIGS. 7A, 7B and 7C are schematic plan views illustrating the operational states of gears according to the operating mode of the squeegee roller driving apparatus for a liquid electrophotographic printer according to the present invention shown in FIG. 6.

Referring to FIG. 7A, in a drip line removal mode, the driving gear 250 drives the squeegee gear 240 to rotate in a reverse direction to the circulating direction of the photoreceptor belt 10 in a printing mode. Accordingly, while the squeegee roller 230 keeps pressing the photoreceptor belt 10 with a loading force of approximately 2 kilograms by adjusting the elastic force of the spring of the elevation apparatus (not shown), it rotates in a reverse direction to the rotating direction of the photoreceptor belt 10 in the printing mode. Here, the carrier accumulating and remaining between the photoreceptor belt 10 and the squeegee roller 230 to form the drip line D, is pushed back to be removed.

Figure 7B:
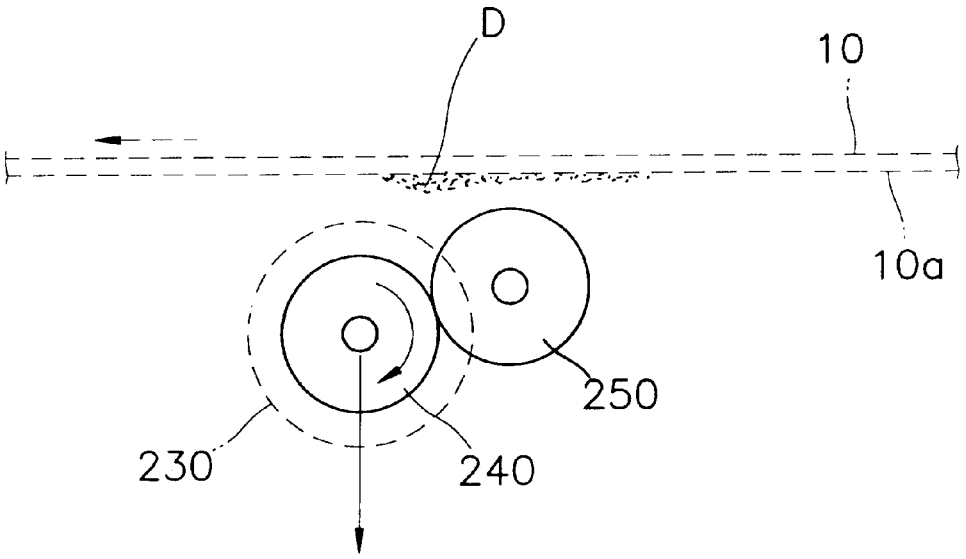
Figure 7C:
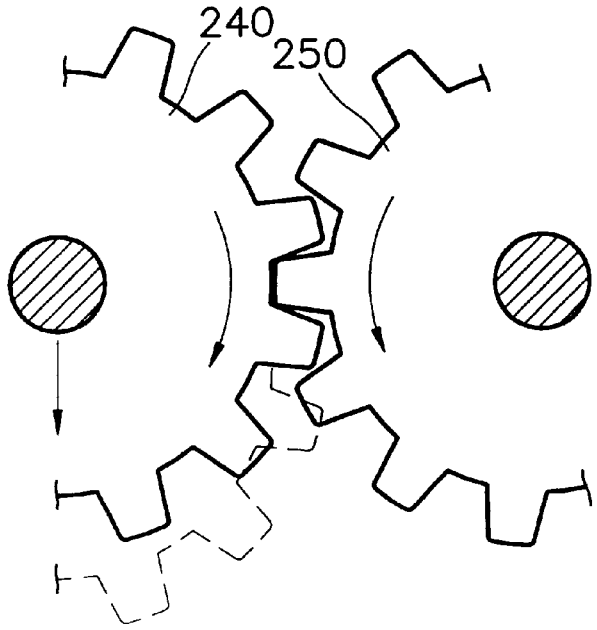

During the above-described procedure, if the drip line removal mode is terminated to then be switched to the stop mode, the squeegee roller 230 is slowly lowered by the elevation apparatus (not shown) to begin disengaging from the photoreceptor belt 10, as shown in FIG. 7B. In this case, the squeegee gear 240 is lowered while it keeps rotating in reverse, as shown in FIG. 7C. Also, when the squeegee roller 230 is further lowered to be completely disengaged from contact from the photoreceptor belt 10, the engagement between the squeegee gear 240 and the driving gear 250 is released, so that the squeegee roller 230 stops rotating.

Figure 8:
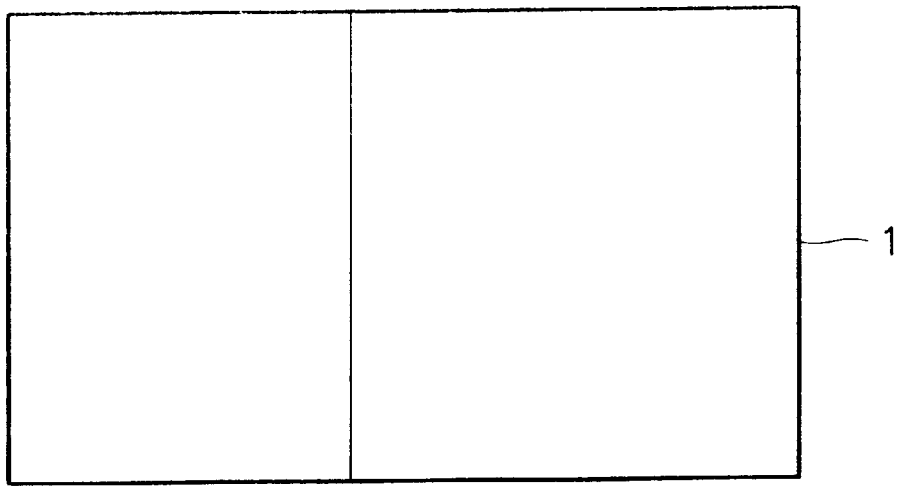
FIG. 8 is a schematic plan view illustrating the state of a printed image when the squeegee roller driving apparatus for a liquid electrophotographic printer according to the present invention shown in FIG. 6 is adopted.

Therefore, according to the present invention, even when the drip line removal mode of the printer is terminated to be switched to the stop mode, the squeegee roller 230 in contact with the transfer surface of the photoreceptor belt 10 does not stop but keeps rotating in reverse until it is completely disengaged from the photoreceptor belt 10, thereby removing the drip line D as accurately as possible. In other words, in the squeegee roller driving apparatus according to the present invention, only a small amount of carrier (approximately 0.002 gram or less) remains on the transfer surface of the photoreceptor belt 10 after removing the drip line. Thus, as shown in FIG. 8, the amount of carrier transferred to the printing paper 1 is minimized, thereby greatly improving the print quality of the ultimately printed image.

What is claimed is:

1. An apparatus for driving a squeegee roller of a liquid electrophotographic printer, comprising:

a squeegee roller installed to be operative to rotate in contact with a photoreceptor belt circulating along a track and to be lifted to and lowered from the photoreceptor belt, the photoreceptor belt circulating along the track at least during lowering of the squeegee roller for disengagement from the photoreceptor belt;

a squeegee gear coaxially installed at one shaft end of a rotation shaft of the squeegee roller;

a driving gear installed such that in a state where the squeegee roller contacts the photoreceptor belt, a center of a rotation shaft thereof is positioned on a plane perpendicular to an elevating direction of the squeegee roller and passing through a center of the rotation shaft of the squeegee roller, to be engaged with the squeegee roller; and a driving source having an output shaft for rotating the driving gear to drive the squeegee roller to rotate in a reverse direction to a circulating direction of the photoreceptor belt, wherein the squeegee roller continues to rotate in the reverse direction until the squeegee roller is disengaged from the photoreceptor belt.

2. An apparatus for driving a squeegee roller of a liquid electrophotographic printer, comprising:

a squeegee roller installed to be operative to rotate in contact with a photoreceptor belt circulating along a track and to be lifted to and lowered from the photoreceptor belt;

a squeegee gear coaxially installed at one shaft end of a rotation shaft of the squeegee roller;

a driving gear installed such that in a state where the squeegee roller contacts the photoreceptor belt, a center of a rotation shaft thereof is positioned on a plane perpendicular to an elevating direction of the squeegee roller and passing through a center of the rotation shaft of the squeegee roller, to be engaged with the squeegee roller; and a driving source having an output shaft for rotating the driving gear to drive the squeegee roller to rotate in a reverse direction to a circulating direction of the photoreceptor belt, wherein the driving gear is positioned upstream of the squeegee gear with respect to the circulating direction of the photoreceptor belt to be engaged therewith.

* * * * *